United States Patent [19]

Ress, Jr.

[11] 4,306,761

[45] Dec. 22, 1981

[54] TERMINAL WITH RESILIENTLY SUPPORTED CONTACT BOW

[75] Inventor: Robert A. Ress, Jr., Mineral Ridge, Ohio

[73] Assignee: General Motors Corporation, Detroit, Mich.

[21] Appl. No.: 139,164

[22] Filed: Apr. 11, 1980

[51] Int. Cl.[3] ..... H01R 11/02

[52] U.S. Cl. ..... 339/252 R

[58] Field of Search ..... 339/176 MP, 252 R, 252 P, 339/258 R, 258 P

[56] References Cited

U.S. PATENT DOCUMENTS

| | | | |
|---|---|---|---|
| 2,982,939 | 5/1961 | Kirk | 339/128 |
| 3,149,899 | 9/1964 | Johanson | 339/258 |
| 3,393,396 | 7/1968 | Majewski | 339/252 R |
| 3,626,361 | 12/1971 | Bonhomme | 339/252 R |
| 4,070,088 | 1/1978 | Vaden | 339/252 R |

*Primary Examiner*—Joseph H. McGlynn

*Attorney, Agent, or Firm*—F. J. Fodale

[57] ABSTRACT

An electrical terminal has a flexible contact bow which is integrally connected to an end of the rigid planar base by a curved nose bend. The contact bow has resilient, two-point support means at the opposite end which comprises a curved tail bend and an L-shaped support disposed between the contact bow and the rigid planar base. The L-shaped support includes a depending leg which slidably engages the rigid planar base to provide a first support point for the contact bow. The curved tail bend engages the rigid planar base after the depending leg engages to provide a second support point for the contact bow.

2 Claims, 6 Drawing Figures

PRIOR ART

TERMINAL WITH RESILIENTLY SUPPORTED CONTACT BOW

This invention relates generally to electrical terminals and more particularly to electrical terminals having a flexible contact bow.

In a known prior art terminal, shown in FIG. 1 of the accompanying sheet of drawing, the flexible contact bow is connected to a rigid planar base by a curved nose bend. When the contact bow is depressed, the free end of the contact bow engages the rigid planar base of the terminal so that upon further depression the contact bow is supported in the manner of a simple beam. While this prior terminal is suitable for many purposes, the flexible contact bow has a limited deflection range because of yielding in the area of the curved nose bend which connects the flexible contact bow to the rigid planar base of the terminal.

The object of this invention is to provide a terminal of the above type wherein the flexible contact bow has a higher deflection range than that of the prior art terminal and which still fits within the overall dimensions of the prior art terminal.

Other objects and features of the invention will become apparent to those skilled in the art as the disclosure is made in the following detailed description of a preferred embodiment of the invention as illustrated in the accompanying sheet of drawing in which.

Figure 1:
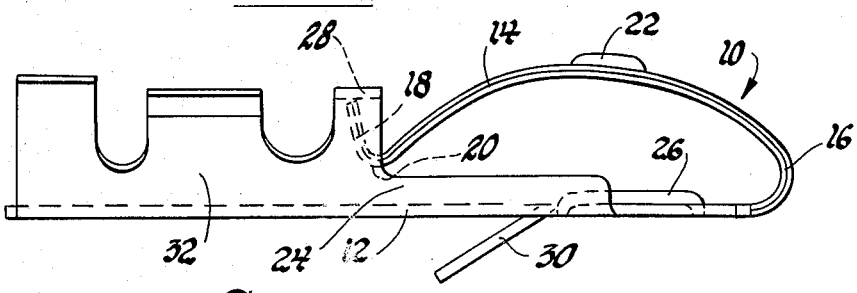
FIG. 1 is a side view of the prior art terminal discussed above.

Referring now to the drawing, FIG. 1 shows a prior art terminal 10 which has been manufactured by the assignee of this invention for many years.

The prior art terminal 10 comprises a rigid generally planar base 12 and a resilient contact bow 14 which is disposed above the base 12 and integrally connected to a forward end of the base 12 by a curved nose bend 16. The opposite end of the contact bow 14 is free and has a turned-up foot 18 connected to it by a small curved bend 20. The contact bow 14 has a raised contact dimple 22 at its high point which is more or less conventional.

The terminal 10 has stepped side walls 24 connected to opposite edges of the rearward portion of the base 12 and the forward portion of the base 12 has a raised stamped rib 26 which extends back into the area between the side walls 24. The side walls 24 and stamped rib 26 help rigidify the planar base 12.

The higher parts of the stepped side walls 24 have turned-in flanges 28 which lie above the foot 18 to limit outward movement of the flexible contact bow 14 and protect the contact bow 14 during handling. The terminal 10 also has a conventional latch tang 30 stamped and bent from the base 12 and a conventional cable attachment portion 32 at the rearward end of the base 12.

In use, depression of the flexible contact bow 14 is initially resisted solely by closing of the curved nose bend 16 until the small curved bend 20 engages the base 12. Thereafter the flexible contact bow 14 is supported as a simple beam and further depression is resisted by flattening of the contact bow 14 as well as further closing of the curved nose bend 16. Deflection or depression is limited by the curved nose bend 16 which yields at some point when the the contact bow 14 is depressed beyond a certain amount. After yield in the nose bend area, the flexible contact bow 14 does not return to its original position when released.

Figure 2:
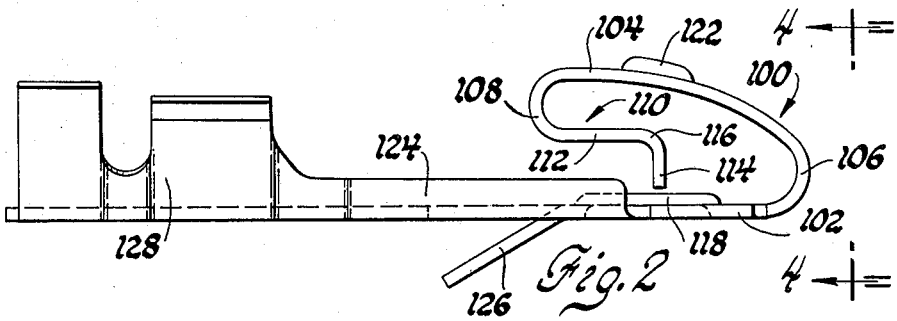
FIG. 2 is a side view of a terminal in accordance with this invention.
Figure 3:
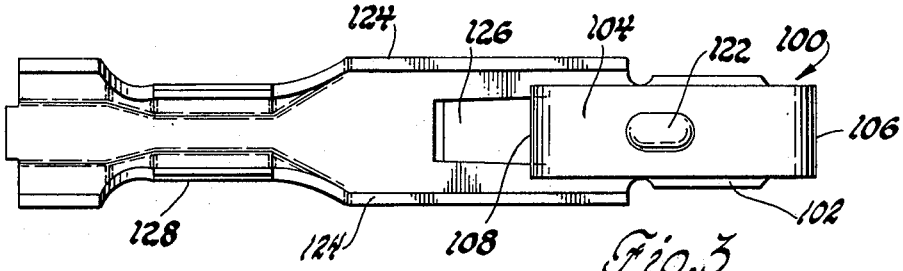
FIG. 3 is a top view of the terminal shown in FIG. 2.
Figure 4:
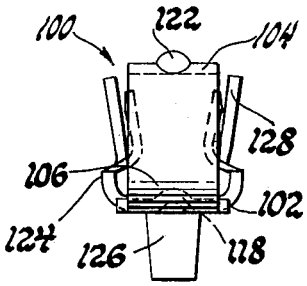
FIG. 4 is a front view of the terminal shown in FIG. 2.

FIG. 2 shows a terminal 100 in accordance with this invention which has an improved means for supporting the contact bow so as to increase the deflection range of the flexible contact bow.

As in the prior art device, the improved terminal 100 comprises a rigid generally planar base 102 and a resilient contact bow 104 which is disposed above the base 102 and integrally connected to a forward end of the base 102 by a curved nose bend 106. The resilient contact bow 104 and curved nose bend 106 have substantially the same contour as in the prior art device except that the resilient contact bow 104 is considerably shorter. The opposite or free end of the contact bow 104 has a resilient two-point support means connected to it.

The support means comprises a curved tail bend 108 and an L-shaped support 110. The curved tail bend 108 extends toward the base 102 and holds the L-shaped support 110 between the contact bow 104 and the base 102. FIG. 2 shows the terminal 110 in a free or unflexed state. In this condition the longer leg 112 of the L-shaped support 110 is substantially parallel to the base 102 and the shorter depending leg 114 which is connected to the leg 112 by a quarter bend 116 terminates close to a raised stamped rib 118 of the base 102. The contact bow 104 has a raised contact dimple 122 near its high point which is more or less conventional.

As in the prior art device the terminal 100 has side walls 124 connected to opposite edges of the rearward portion of the base 102. These side walls and the raised stamped rib 118 which extends from the forward portion of the base 102 back into the area between the side walls 124 help rigidify the planar base 102. The terminal 100 also has a conventional latch tang 126 stamped and bent from the base 102 and a conventional cable attachment portion 128 at the rearward end of the base 102.

In use, depression of the flexible contact 104 is initially resisted solely by closing of the curved nose bend 106 until the depending leg 114 engages the raised stamped rib 118 of the base 102. Thereafter the free end of the flexible contact bow 104 is supported by the resilient, double contact support means and further depression is resisted by several portions of the terminal 100 so that the flexible contact bow 104 has a much higher deflection range than the prior art device.

These portions are: the curved nose bend 106 which continues to close up; the curve tail bend 108 which also closes up; the quarter bend 116 which opens up as the leg 114 slides forward on the rib 118; and finally the contact bow 104 itself which flattens.

Figure 5:
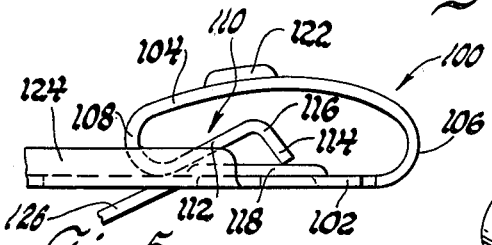
FIG. 5 is a partial side view of the terminal of FIG. 2 showing the deflected shape of the flexible contact bow and its support means.
Figure 6:
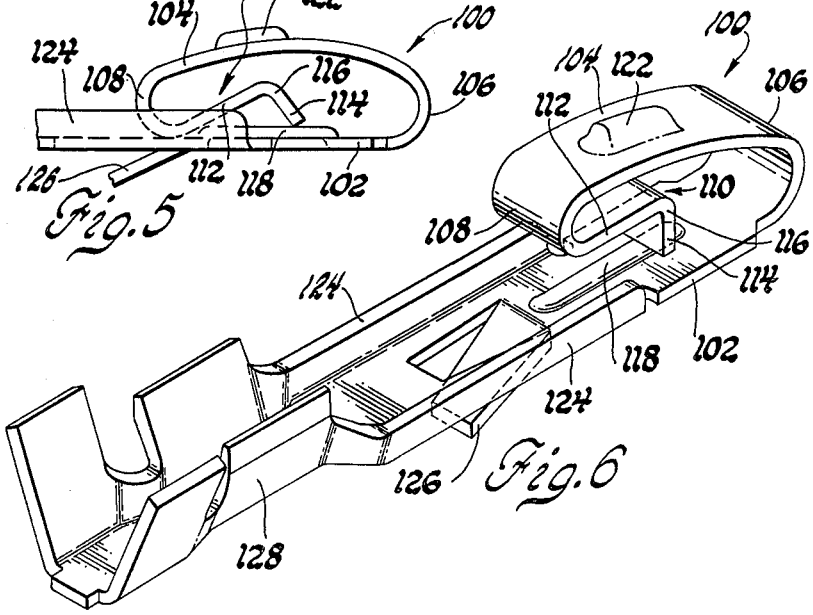
FIG. 6 is a perspective view of the terminal shown in FIGS. 2 through 5.

FIG. 5 shows the shape of the flexible contact bow 104 and its supports after the contact bow 104 has been depressed a considerable amount. In this condition the nose and tail bends 106 and 108 have closed up in comparison to their free state configuration. On the other hand the quarter bend 116 has opened up. This is slightly more evident from the obtuse angle formed by the legs 112 and 114 in comparison to the right angle formed by these legs in the free state. The bow 104 has also flattened slightly. Besides providing additional areas, that is the tail and quarter bends 108 and 116 to resist depression, another feature of the invention is the two-point support after considerable depression. That is, the tail bend 108 also engages the rib 118 after a certain amount of depression. When this occurs the support bow 104 is almost rigidly supported. This protects the bends 106, 108 and 116 from being overstressed and yielding. Thereafter only a slight further depression is possible primarily by a little more flattening of the contact bow 104.

I wish it to be understood that I do not desire to be limited to the exact details of construction shown and described, for obvious modifications will occur to a person skilled in the art.

The embodiments of the invention in which an exclusive property or privilege is claimed are defined as follows:

1. In an electrical terminal having a rigid planar base and a flexible contact bow which lies above the rigid planar base and which has one end integrally connected to an end of the rigid planar base by a curved nose bend, the improvement comprising:

a curved tail bend at the opposite end of the contact bow which extends toward the rigid planar base, a two-legged support disposed between the contact bow and the rigid planar base, said support having a leg which is connected to the contact bow by the curved tail bend end and which extends toward the curved nose bend, and a depending leg which slidably engages the rigid planar base responsive to depression of the contact bow toward the rigid planar base to provide support for the contact bow, and said curved tail bend being engageable with the rigid planar base responsive to further depression of the contact bow to provide further support for the contact bow.

2. In an electrical terminal having a rigid planar base and a flexible contact bow which lies above the rigid planar base and which has one end integrally connected to an end of the rigid planar base by a curved nose bend, the improvement of resilient, two-point support means at the opposite end of the contact bow which comprises:

a curved tail bend at the opposite end of the contact bow which extends toward the rigid planar base, an L-shaped support disposed between the contact bow and the rigid planar base, said support having a leg which is connected to the contact bow by the curved tail bend end and which extends toward the curved nose bend, and a depending leg which is connected to the aforementioned leg by a quarter bend and which slidably engages the rigid planar base responsive to depression of the bow-shaped contact toward the rigid planar base to provide a first support point for the contact bow, and said curved tail bend being located and shaped so that it is engageable with the rigid planar base after the depending leg engages and responsive to further depression of the contact bow to provide a second support point for the contact bow.

* * * * *